US006077097A

United States Patent [19]

Kumakura et al.

[11] Patent Number: 6,077,097

[45] Date of Patent: Jun. 20, 2000

[54] LOW COUPLING FORCE CONNECTOR

[75] Inventors: Hideto Kumakura; Shinji Kodama, both of Shizuoka, Japan

[73] Assignee: Yazaki Corporation, Tokyo, Japan

[21] Appl. No.: 09/234,453

[22] Filed: Jan. 21, 1999

[30] Foreign Application Priority Data

Jan. 22, 1998 [JP] Japan ..... 10-010645

[51] Int. Cl.[7] ..... H01R 13/62

[52] U.S. Cl. ..... 439/157; 439/347

[58] Field of Search ..... 439/157, 310, 439/347, 152–156, 158–160

[56] References Cited

U.S. PATENT DOCUMENTS

| | | | |
|---|---|---|---|
| 4,586,771 | 5/1986 | Kraemer et al. | 439/157 |
| 5,899,762 | 5/1999 | Ainceri | 439/157 |
| 5,902,141 | 5/1999 | Iwahori | 439/157 |
| 5,928,013 | 7/1999 | Iwahori | 439/157 |
| 5,957,707 | 9/1999 | Kodama | 439/157 |

FOREIGN PATENT DOCUMENTS

| | | |
|---|---|---|
| 61-203581 | 9/1986 | Japan . |
| 4-319271 | 11/1992 | Japan . |
| 5-1178 | 1/1993 | Japan . |

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

A slider used for coupling connectors is provided at the bottom with an engagement projection, and one of the connectors is provided with a guide slit for receiving the engagement projection. In a form, the slider is provided at the bottom with a pair of engagement grooves, and the guide slit has at both sides guide rails engageable in the engagement grooves. The slider is provided on one side wall with a slider support consisting of an engagement portion and a support portion projecting from the engagement portion, and the connector housing is provided on a wall thereof with a guide slit across which the engagement portion extends to have the support portion contacting the wall of the connector housing. Displacement of the slider used for coupling the connectors and enlargement of connectors can be prevented.

12 Claims, 9 Drawing Sheets

LOW COUPLING FORCE CONNECTOR

BACKGROUND OF THE INVENTION

1. Field of the Invention

This invention relates to a low coupling force connector in which, to couple a pair of mating connector housings, a slider is smoothly slidable without displacement inside one of the connector housings, with a cam means of the slider being engaged with an engagement protrusion provided on the other connector housing.

2. Description of the Related Art

FIG. 14 shows a conventional low coupling force connector proposed in Japanese Patent Application Unexamined Publication No. Hei 4-319271.

This low coupling force connector includes a female connector housing 80 having not-shown male terminals projected therein, a slider 82 with a pair of slider plates 81 insertable into the female connector housing 80 at its upper and lower sides, a connector casing 83 movable into the female connector housing 80, and male connector housings 84 which are rigidly fixed in the connector casing 83.

Each slider plate 81 is formed with cam grooves 85, and the connector casing 83 is provided with engagement protrusions 86 engageable in the cam grooves 85. The female connector housing 80 is provided with insertion holes 87 and guide rails 88 for the slider plates 81.

The male connector housings 84 are fitted in the connector casing 83 to be locked there, while the slider plates 81 are inserted into the female connector housing 80, followed by initially fitting the connector casing 83 in the female connector housing 80 to bring the engagement protrusions 86 of the former into engagement with the cam grooves 85 of the latter, so that on pushing the slider 82, the connector housings 80, 84 are coupled to each other with low force, and that male terminals (not shown) located inside the female connector housing 80 and female terminals 89 located inside the male connector housing 84 are connected to each other.

With the conventional structure as mentioned above, however, because guide rails 88 for the slider plates 81 are disposed on opposite sides inside the female connector housing 80, a reduction is made in the space for accommodating the male connector housings 84. To avoid this, the female connector housing 80 needs to be enlarged in a direction perpendicular to the connector-fitting direction. Another drawback is that cam grooves 85 need to be formed at positions on the slider plates 81 as will avoid interference with the guide rails 88, resulting in a limitation to the freedom of designing. The conventional structure is also disadvantageous in that a slider-pushing and -drawing portion 90 protrudes largely outwardly, making the connector enlarged perpendicularly to the connector-fitting direction. Without the guide rails 88, the slider plates 81 will be bent inwardly, making it impossible to slide the connectors smoothly into and out of coupling with each other.

FIG. 15 shows another conventional low coupling force connector as proposed in Japanese Utility Model Application Unexamined Publication No. Hei 5-1178.

This low coupling force connector includes a slider 91 and guide rails 92 for the slider, which are provided externally of a female connector housing 93. In this way, a space is secured inside the female connector housing 93 for receiving a male connector housing 94. A guide groove 96 extends inside the guide rails 92 for guiding therealong an engagement protrusion 95 provided on the male connector housing 94 and thus the male connector housing 94 in a coupling direction with the female connector housing 93.

With this structure, however, the female connector housing 93 is the more enlarged because of the guide rails 92 provided externally. Without the guide rails 92, it becomes impossible to hold the slider 91 in position on the female connector 93, resulting in an unsmooth coupling and decoupling of the connectors.

SUMMARY OF THE INVENTION

This invention has been accomplished to overcome the above drawbacks and an object of this invention is to provide a low coupling force connector in which a slider is firmly held to enable a smooth connector coupling and decoupling, and which prevents connector housings from being enlarged.

In order to attain the object, according to this invention, there is provided a low coupling force connector which comprises: a pair of first and second connector housings fittable to each other; a slider insertable into the first connector housing, the slider having a cam means provided thereon; and an engagement protrusion provided on the second connector housing, slidable in the cam means, wherein the slider has an engagement projection at an end thereof remote, in a fitting direction of the first and second connector housings, from the second connector housing, and the first connector housing has a guide slit for insertion therein of the engagement projection of the slider.

Preferably, the engagement projection extends on an end surface of the slider to lie in the same plane as the slider lies.

Advantageously, the guide slit is located inside the first connector housing.

Preferably, the slider has an enlarged portion at a free end of the engagement projection to provide a pair of engagement grooves at opposite sides of the slider, and the guide slit forms a pair of guide rails at opposite sides thereof which engage in the pair of engagement grooves.

Preferably, the pair of engagement grooves are provided at opposite sides of the slider in a width direction of the slider.

Preferably, the slider has a support for sliding projecting at one side thereof, which includes an engagement portion and a support portion projecting from the engagement portion, and the first connector housing is provided in one wall thereof with a guide slit through which the engagement portion extends to have the support portion contacted with the one wall of the first connector housing.

Preferably, the support for sliding extends for a part or all of the entire length of the slider in a sliding direction thereof.

Preferably, the support portion projects perpendicularly, in one direction, from the engagement portion.

Preferably, the support portion projects perpendicularly, in two opposite directions, from the engagement portion.

Advantageously, the low coupling force connector further comprises a connector casing in which the first and second connector housings are fitted to each other, the connector casing having a second cam means provided thereon, and the engagement portion and the support portion of the support for sliding have small and large diameters, respectively, to constitute a follower protrusion slidable in the cam means of the connector casing.

Preferably, two of the sliders are provided symmetrically by 180° rotation to be insertable into the first connector housing from opposite directions.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described with reference to the attached drawings.

Figure 1:
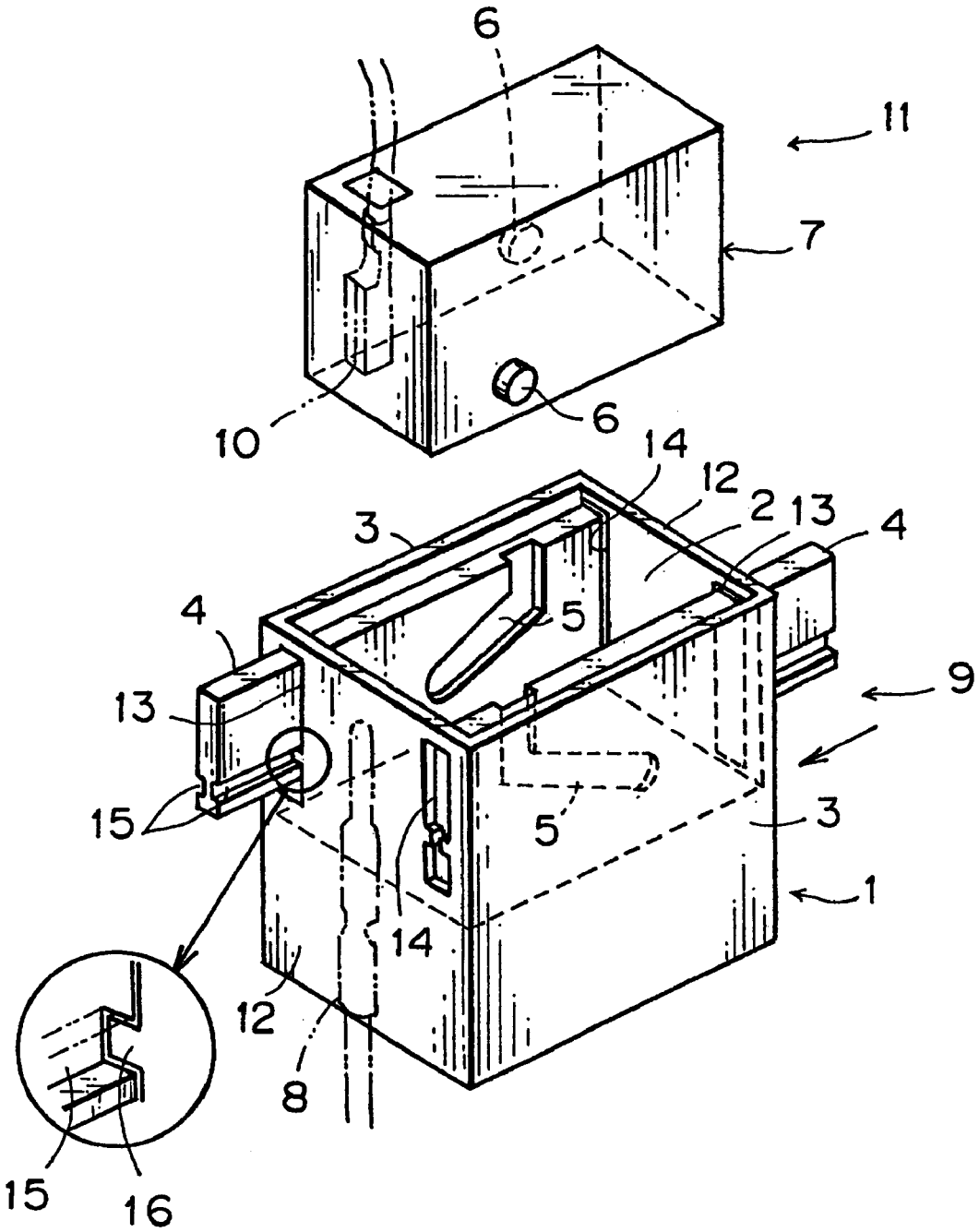
FIG. 1 is a perspective view of a low coupling force connector according to a first embodiment of this invention, shown deassembled.

FIG. 1 shows a low coupling force connector according to a first embodiment of this invention.

This low coupling force connector includes a synthetic-resin made female connector housing 1 with a hood defining a connector-fitting chamber 2 therein, a pair of synthetic-resin made sliders 4, 4, each having a cam groove 5, disposed symmmetrically by 180° rotation inside the connector-fitting chamber 2 and slidably along two opposite hood walls (major walls) 3, 3, and a synthetic-resin made male connector housing 7 having engagement protrusions 6 engageable in the slider cam grooves 5. Male terminals 8 are received in the female connector housing 1 to form a female connector 9, and female terminals 10 are received in the male connector housing 7 to form a male connector 11.

The pair of sliders 4, 4 are elongate and extend along the hood walls 3, 3 of the female connector housing, with their proximal ends protruding outside through slider insertion holes 13 provided in hood walls (minor walls) 12, 12 and their distal ends located close to slider passing holes 14 provided in the opposite hood walls 12, 12. The sliders 4, 4 extend through the female connector housing 1 when pushed.

Each slider 4 is provided at left and right sides at the bottom with a pair of engagement grooves 15 extending in a sliding direction of the slider, and the female connector housing 1 is provided with a pair of projecting guide rails 16 for engagement in the respective pair of engagement grooves 15.

Figure 2:
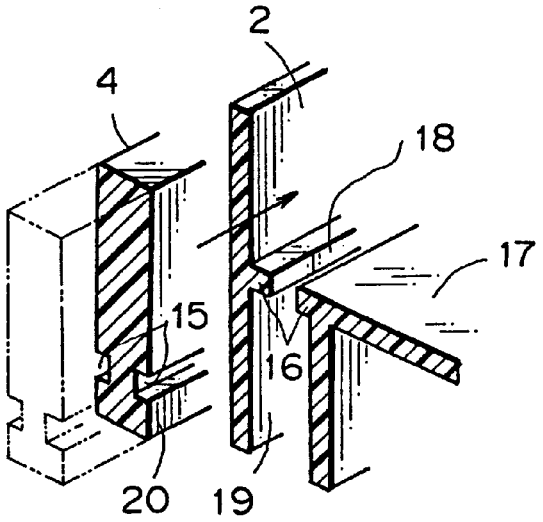
FIG. 2 is a perspective view of a slider being inserted into a female connector housing according to the first embodiment.

As shown in FIG. 2, the pair of guide rails 16 are formed by making a guide slit 18 in a bottom wall 17 of the connector-fitting chamber 2. The guide slit 18 communicates to an empty chamber 19 therebelow. The slider 4 has an expanded portion 20 at the bottom, at the lower side of the engagement grooves 15, slidably engaged in the empty chamber 19. The slider 4 is stably supported by the pair of guide rails 16 from both sides in a thickness direction of the slider to be smoothly slidable. Owing to the structure in which the engagement grooves 15 are provided at the bottom of the slider 4 and the corresponding guide rails 16 are cut in the bottom wall 17 of the connector-fitting chamber 2, the connector-fitting chamber is internally free of protrusions such as those formed by the conventional guide rails, leading to an effective utilization of the connector-fitting space inside the connector-fitting chamber 2.

In FIG. 1, with the sliders 4 drawn outwardly, the male connector 11 is initially engaged in the connector-fitting chamber 2 of the female connector 9, after which the sliders 4, 4 are pushed in opposed directions, at which time each engagement protrusion 6, which has been engaged in the re spective cam groove 5, is guided along the respective cam groove 5 in a direction to couple the female and male connectors 9, 11 together with low force. The male and female connectors 9, 11 are decoupled with low force when the sliders 4, 4 are drawn out.

According to the first embodiment as described above, the sliders 4 are firmly held in position by the simple shapes employed which do not require cost. Further, because the hood walls of the connector housing 1 are free of protrusions for supporting the sliders 4, the downsizing of the connector 9 is attainable.

Figure 3:
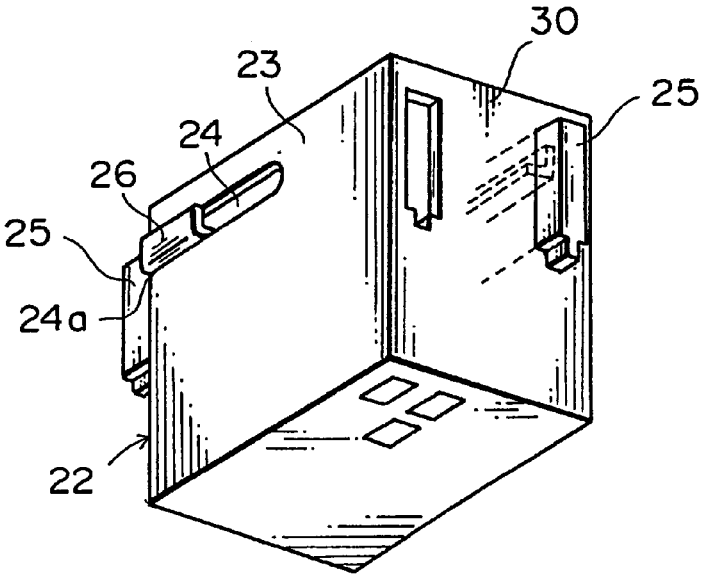
FIG. 3 is a perspective view of a low coupling force connector (female connector) according to a second embodiment of this invention.

FIG. 3 shows a low coupling force connector according to a second embodiment of this invention.

This low coupling force connector is featured by straight guide slits 24 provided horizontally in opposite walls (major walls) 23 of a female connector housing 22 and slider supports 26 of L-shaped (hook-shaped) cross section provided on a pair of sliders 25, 25, which slider supports are engageable in the guide slits 24.

Each slider 25 is formed with a not-shown cam groove as in the preceding example. The slider support 26 may extend for a part or all of the entire length of the slider 25 in a longitudinal (sliding) direction thereof.

Figure 4:
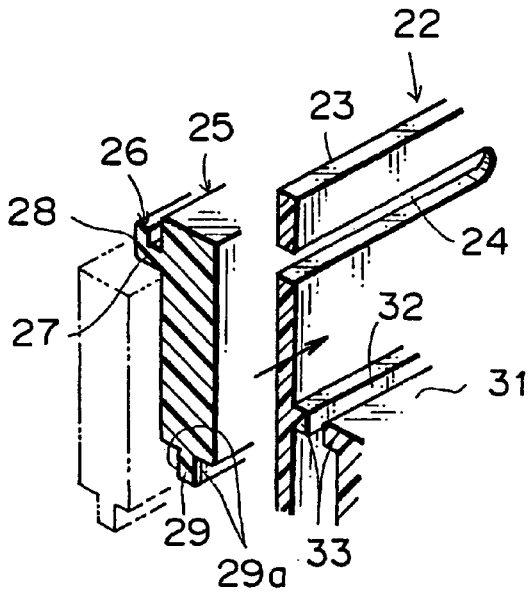
FIG. 4 is a perspective view of a slider being inserted into a female connector housing according to the second embodiment.

As shown in FIG. 4, the slider support 26 is made up of an engagement portion 27 projecting perpendicularly from an outer wall of the slider 25 and a support portion 28 upstanding vertically from the engagement portion 27. In this example, the slider 25 has an engagement projection 29 extending in a longitudinal direction on the lower end surface of the slider, which engagement projection slidably engages in a guide slit 32 provided in a bottom wall 31 of a connector-fitting chamber 30 (FIG. 5) of the female connector housing 22. At both sides of the guide slit 32 are extended, as in the preceding example, guide rails 33 which contact both lateral walls 29*a* of the engagement projection 29.

The guide slits 24 are formed in the opposite walls (major walls) 23 of the connector-fitting chamber 30. Each guide slit 24 has an inlet 24*a* (FIG. 3) opening at the related wall (minor wall) 30 of the female connector housing 22. The engagement portion 27 of each slider support 28 is inserted into the respective guide slit 24 through the inlet 24*a*.

Figure 5:
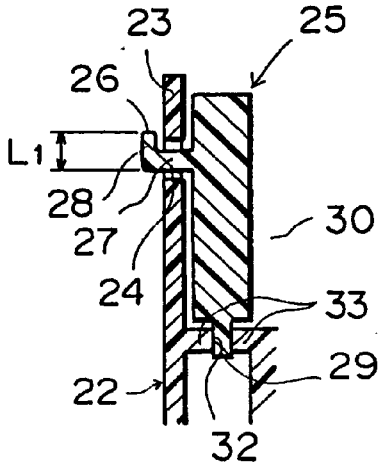
FIG. 5 is a vertical sectional view of the slider of FIG. 4 held on the female connector housing.

As shown in FIG. 5, the engagement portion 27 of the slider support 26 extends across the guide slit 24, with the support portion 28 being in contact with an outer surface of the female connector housing wall 23 to prevent the slider 25 from falling inwardly and rattling during its sliding. The engagement projection 29 at the bottom of the slider 25 engages in the slit 32 to be supported at its both sides by the respective guide rails 33. The height at which the slider support 26 is provided is optionally selectable, though the higher, i.e., the closer to the upper end of the slider 25, the more stable the slider becomes. The slider support 26 is especially advantageously used with a tall slider 25.

Figure 6:
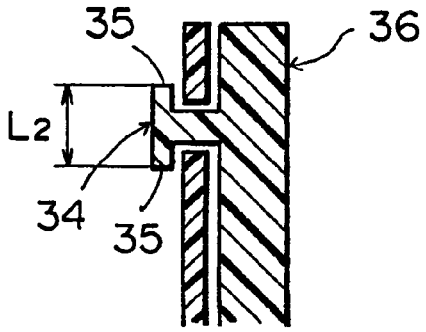
FIG. 6 is a vertical sectional view of another embodiment of an essential portion of a slider holding structure according to this invention.

FIG. 6 shows another embodiment of a slider support 34 which differs from the slider support 26 of FIG. 5 in that it has support portions 35 orientated both upwardly and downwardly (the support portion 28 of FIG. 5 slider support 26 extends only upwardly). This provides a more reliable support against falling of the slider 36.

The shapes and projecting lengths (heights) $L_1$, $L_2$ of the support portions 28, 35 are optionally settable, and an improved stability against the falling and rattling during sliding of the slider 25, 36 will be obtained by increasing the projecting lengths.

Figure 7:
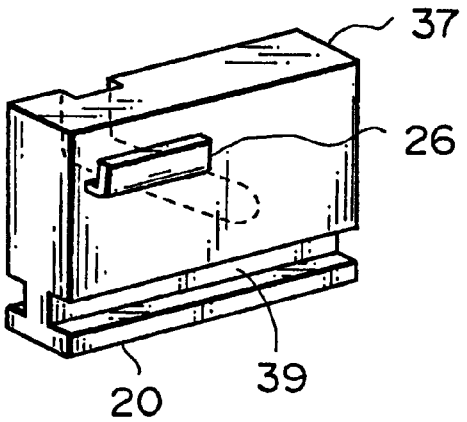
FIG. 7 is a perspective view of another embodiment of a slider according to this invention.

As shown in FIG. 7, the engagement grooves 39 and the expanded engagement portion 20 at the lower side thereof as in the embodiment of FIG. 1 may be used in combination with the slider support 26 or 34 (FIG. 6) to constitute a slider 37. This structure enables the slider 37 to be stably supported at two, upper and lower points (20, 26), better preventing its falling and rattling. Owing to its larger freedom in designing and its larger versatility than before, the shape and location of the slider 37 may be easily optimized for the related connector. Further, since the slider 37 is usable with a conventional structure, a better versatility and reliability is obtained.

Figure 8:
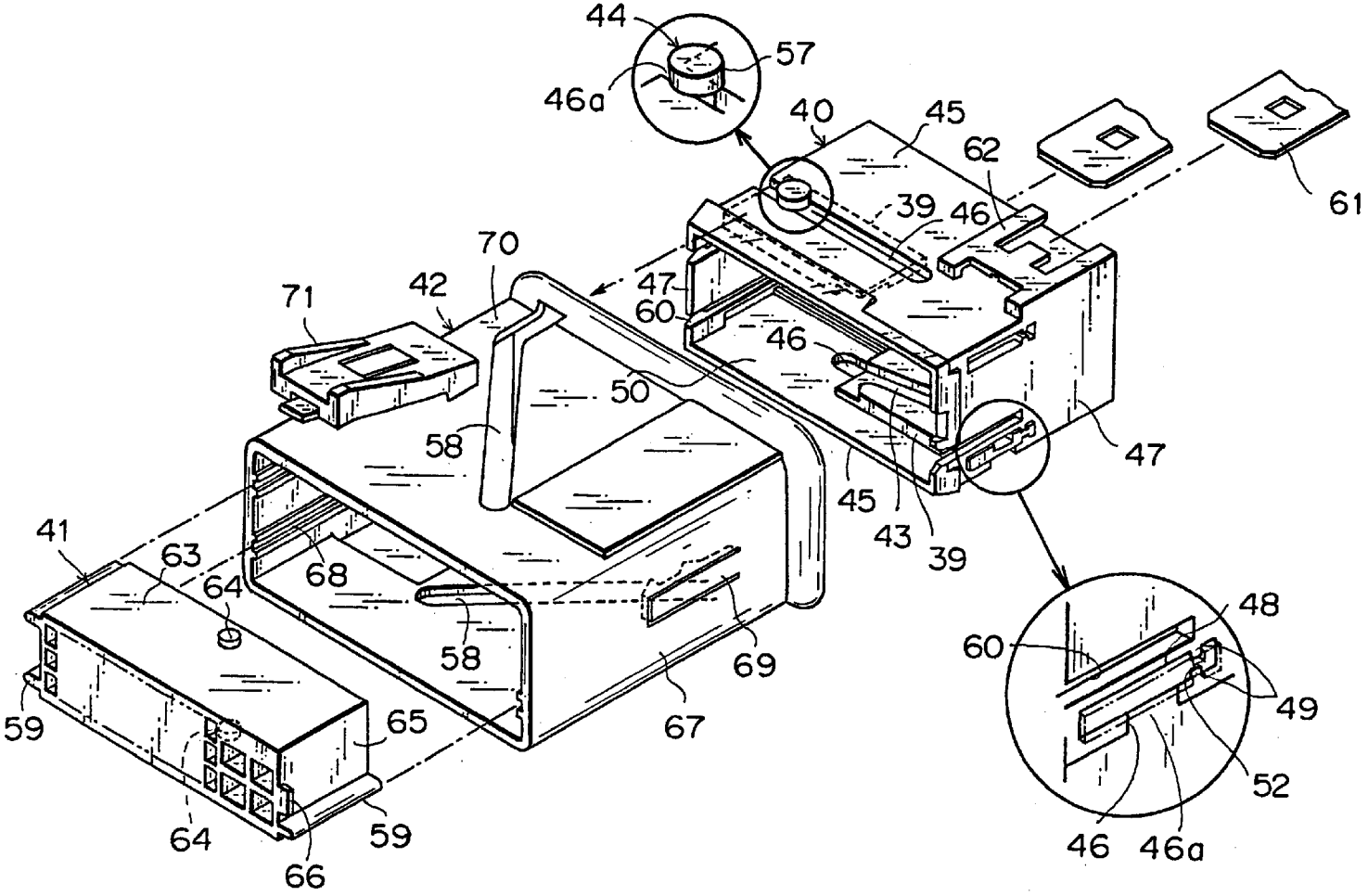
FIG. 8 is an exploded perspective view of a low coupling force connector according to a third embodiment of this invention.

FIG. 8 shows a low coupling force connector according to a third embodiment of this invention.

This low coupling force connector includes a synthetic-resin made female connector housing 40 with a hood defining a connector-fitting chamber 50 therein, a pair of sliders 39, 39 of the same shape, each having a cam groove 43, disposed symmetrically by 180° rotation inside the connector-fitting chamber 50 and slidably along two opposite upper and lower hood walls (major walls) 45, 45, a synthetic-resin made male connector housing 41 having engagement protrusions 64 engageable in the slider cam grooves 43, and a synthetic-resin made connector casing 42 which receives in advance the male connector housing 41 in a position for coupling with the female connector housing 40. Male terminals 72, each with a wire attached, are received in the female connector housing 40 to form a female connector 73 (FIG. 13), and female terminals (not shown) are received in the male connector housing 41 to form a mating male connector.

Each slider 39 has its front end in the vicinity of the center of the female connector housing 40 and the cam groove 43 extending on its inner surface from the slider front end. On its outer surface near the proximal end, each slider 39 has the short column-shaped follower protrusion 44 (FIG. 9), the follower protrusion being slidably engaged in a respective one of straight guide slits 46 provided symmetrically by 180° rotation in the upper and lower walls 45 of the female connector housing 40 to extend perpendicularly to a fitting direction of the female and male connectors. The follower protrusions 44 are advanced into the respective guide slits 46 through inlets 46*a* thereof which open at left and right side walls (minor walls) 47 of the female connector housing 40. The inlet 46*a* communicates to a slider insertion hole 48 located inwardly thereof.

Figure 9:
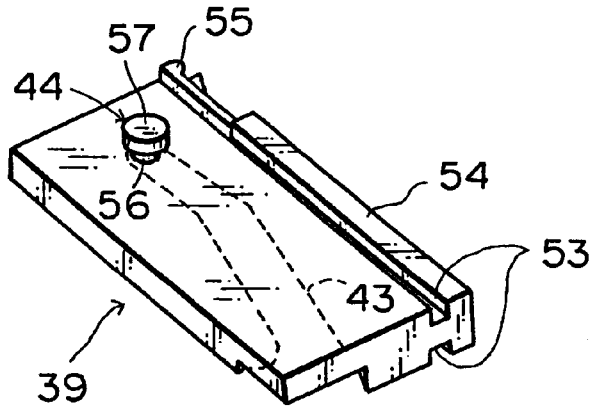
FIG. 9 is a perspective view of a slider of FIG. 8.
Figure 10:
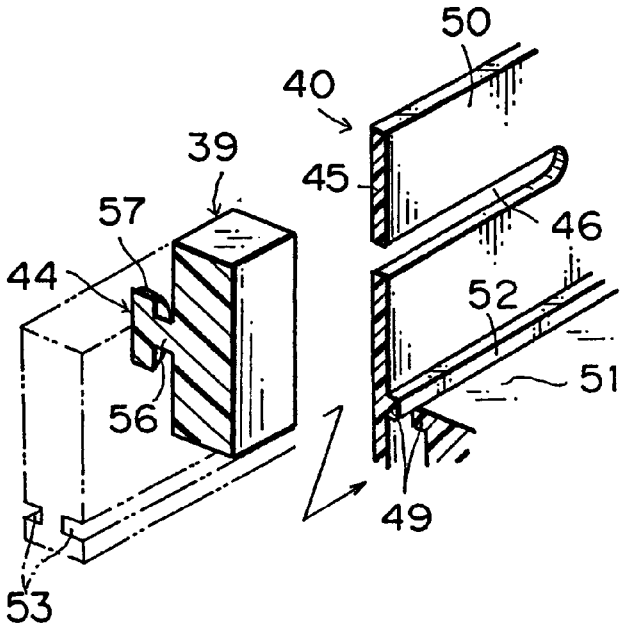
FIG. 10 is a perspective view of the slider of FIG. 8 being inserted into a female connector housing.

As shown in FIGS. 8 and 10, a horizontally extended guide slit 52 is cut in a bottom wall (innermost wall) 51 of the connector-fitting chamber 50 (FIG. 10) to define a pair of guide rails 49 at both sides thereof, which are located in FIG. 8 near the end of the slider insertion hole 48 remote from the male connector housing 41. The slider 39 is formed at the bottom (at the right side in FIG. 9) with a pair of engagement grooves 53 corresponding to the guide rails 49 and an expanded engagement portion 54 adjacent the engagement grooves 53. The expanded engagement portion 54 is provided rearwardly with a resilient lock arm 55 (FIG. 9) which engages an edge of the slider insertion hole 48.

As shown in FIGS. 9 and 10, the follower protrusion 44 is made up of a small diameter engagement portion (shaft portion) 56 engageable in the related guide slit 46 and a large diameter support portion (head portion) 57 formed at the front end of the engagement portion 56. The large diameter support portion 57 also serves, when the female and male connector housings 40, 41 are coupled, as a slider which engages in and slides along a cam groove 58 (FIG. 8) provided in the connector casing 42. The support portion 57 prevents the slider 39 from falling inwardly and rattling.

The slider 39 is stably supported at two points by the guide rails 49 and the follower protrusion 44 and slidable in the direction perpendicular to the connector-fitting direction inside the connector-fitting chamber 50 of the female connector housing 40. The slider 39 in this example has no portion protruding outside the female connector housing 40.

Figure 11:
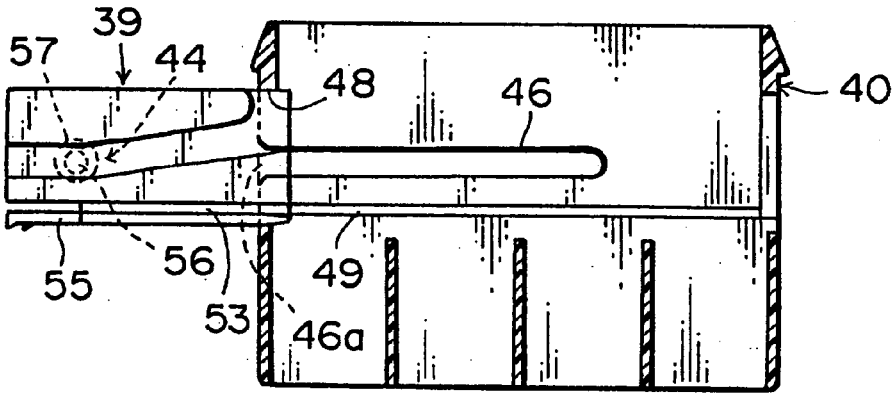
FIG. 11 is a vertical sectional view of the slider of FIG. 8 being inserted into the female connector housing.
Figure 12:
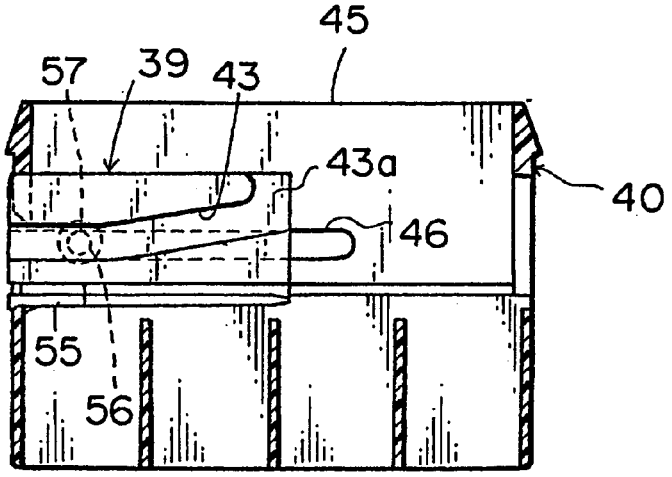
FIG. 12 is a vertical sectional view of the slider of FIG. 8 fully inserted into the female connector housing.

As shown in FIGS. 11 and 12, the slider 39 is inserted into the female connector housing 40 from one side thereof, through the slider insertion hole 48. More specifically, the slider 39 is inserted in the direction perpendicular to the connector-fitting direction, with its engagement grooves 53 fitted over the respective guide rails 49 of the female connector housing 40. As the slider 39 is inserted, the small diameter engagement portion 56 of the follower protrusion 44 slides inside the guide slit 46, and the large diameter support portion 57 moves at an outer side of the guide slit 46. Each support portion 57 prevents the respective slider 39 from falling, so that the latter is located in contact with the respective upper or lower wall 45 of the female connector housing 40 (FIG. 8). When the slider 39 is fully inserted, its lock arm 55 engages with the edge of the slider insertion hole 48 to preliminarily hold the slider 39 in an initial position for coupling the female and male connectors 40, 41 (FIG. 12). In this condition, the front end of the slider 39 is located slightly beyond the center of the female connector housing 40 in the slider insertion direction, so that an inlet 43a of the cam groove 43 is located at the housing center.

In FIG. 8, guide slits 60 for slide projections 59 of the male connector housing 41 are formed in opposite side walls 47 of the female connector housing 40 to extend in the connector-fitting direction. Further, on the upper and lower walls 45 are provided slide engagement portions 62 for engagement therein of a pair of throughbrackets 61 provided projecting, for example, on a meter unit or the like.

The male connector housing 41 is provided on its upper and lower walls 63 with engagement protrusions 64 for engagement in the cam grooves 43 of the sliders 39 and on one of its side walls 65 with a preliminary lock projection 66 for preliminarily locking the male connector hosing 41 in the connector casing 42.

The connector casing 42 is formed on its opposite inner side walls 67 with guide grooves 68 for slide projections 59 provided on the male connector housing 41. The cam grooves 58 are provided symmetrically by 180° rotation in the upper and lower walls 70 of the connector casing 42. On one inner side wall 67 is provided a resilient lock arm 69 for engagement with the preliminary lock projection 66 of the male connector housing 41 to hold the male connector housing in the connector casing 42, with its engagement protrusions 64 located in the cam grooves 58. On each wall is provided a lock arm 71 for locking, for example, to an instrument panel of an automobile (in FIG. 8, only one locking arm 7 is shown for simplicity). Each cam groove 58 extends toward the center of the connector casing 42.

The female connector housing 40 is fixed in advance to the throughbrackets 61 of the meter unit or the like, and the connector casing 42 with the male connector housing 41 preliminarily locked therein is fixed to the instrument panel or the like such that the connector housings 40, 41 with their respective terminals received therein are automatically coupled to each other with low force on assembling the meter unit to the instrument panel, thereby attaining an easy assembly of the meter unit or the like with low force. The connectors are also automatically decoupled with low force by reversing the operation as mentioned above.

Figure 13:
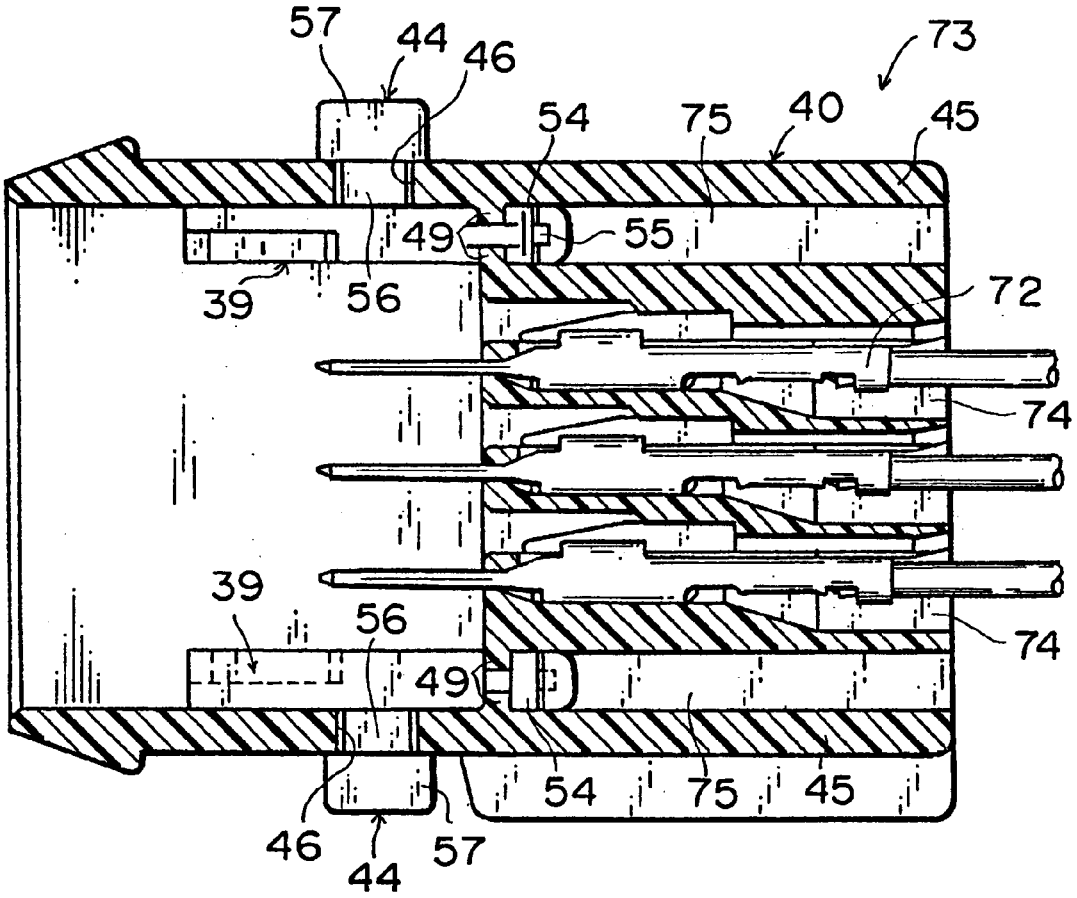
FIG. 13 is a vertical sectional view of the female connector housing with terminals inserted.
Figure 14:
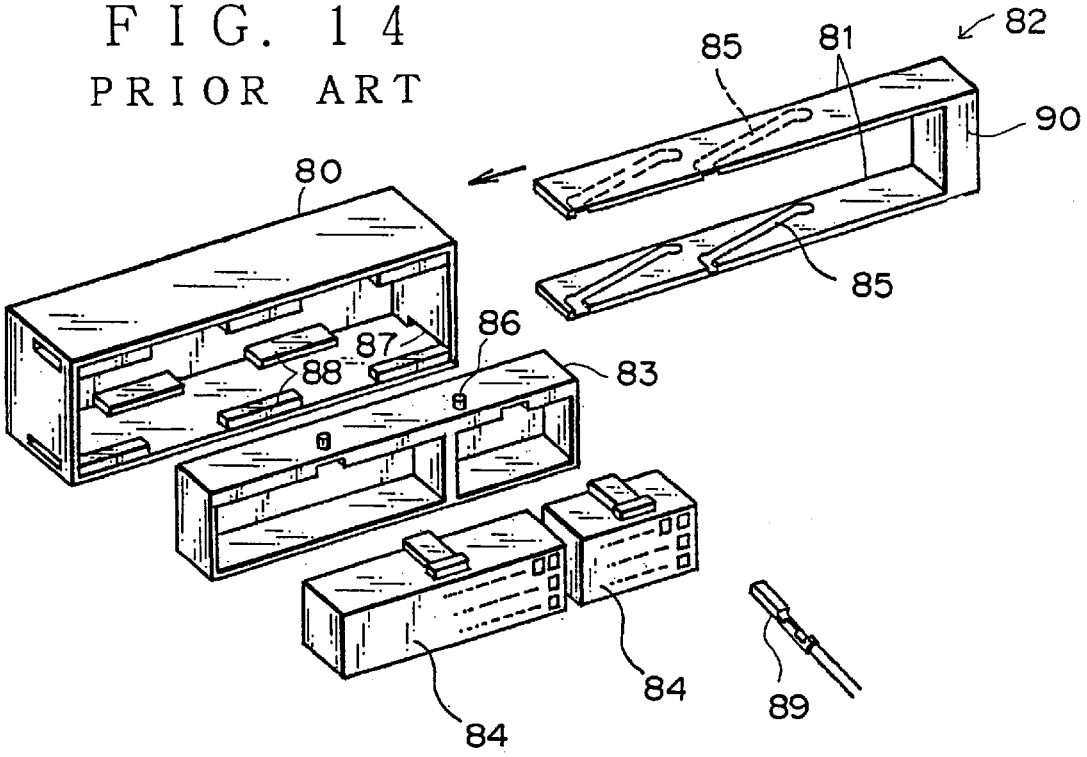
FIG. 14 PRIOR ART
FIG. 14 is a perspective view of a conventional low coupling force connector, shown deassembled.
Figure 15:
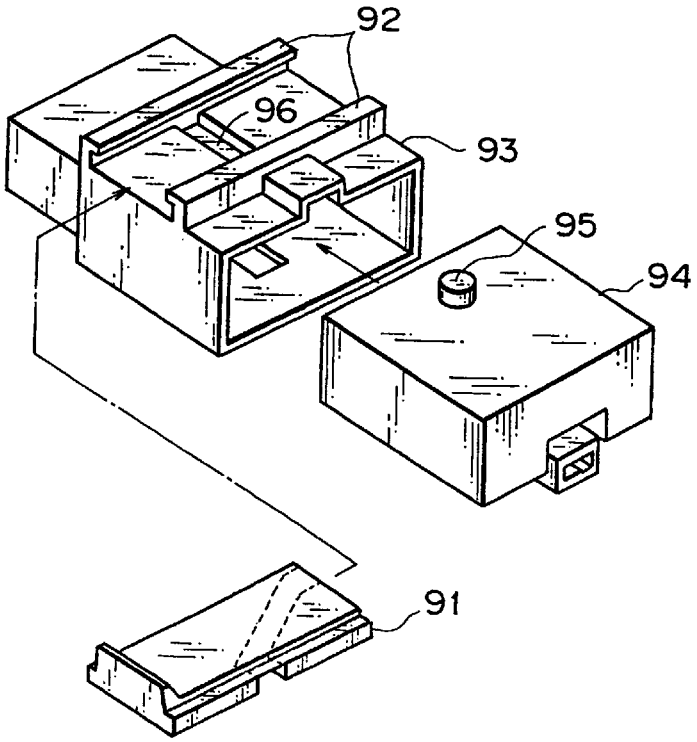
FIG. 15 PRIOR ART
FIG. 15 is a perspective view of another conventional low coupling force connector, shown deassembled.

As shown in FIG. 13, inwardly of both upper and lower walls 45 of the female connector housing 40, adjacent the uppermost and lowermost terminal-receiving chambers 74, empty chambers 75 are formed in which the expanded engagement portions 54 of T-shape cross section and the lock arms 55, both at the end of the slider 39 remote from the male connector, engage through the guide rails 49.

The follower protrusion 44 of each slider 39 has its small diameter engagement portion 56 engaged in the guide slit 46 and its large diameter support portion 57 located in close contact with and stably supported on the outer surface of the respective upper or lower wall 45 of the female connector housing 40. This enables a smooth sliding of the slider 39, and prevents possible interference of the male connector 41 with the slider when coupling the female and male connectors. Further, because the follower protrusion 44 also serves as a support for sliding, no addition or change need be made to the structure for such slide support, making the structure versatile.

The structure for holding sliders according to this invention is not limited in its application to manually-coupling type (FIG. 1) and automatically-coupling type (FIG. 8) low coupling force connectors having a pair of sliders disposed symmetrically by 180° rotation, but also applicable to conventional low coupling force connectors having one slider for coupling connectors.

As described hereinabove, since in this invention the engagement projection of a slider engages in the guide slit provided in a connector housing, the slider can be smoothly slided. Since the connector housing dispenses internally with projections as those by the conventional guide rails, the connector housing can be prevented from being enlarged, or provides a large space for coupling with the mating connector housing and for receiving a multiplicity of terminals, or can be made compact for the same number of terminals as in a conventional connector housing.

Further, according to this invention, because of the guide rails engaging in the pair of engagement grooves on the slider, in addition to the advantages obtained above, a heightwise displacement or rattling of the slider can be prevented, leading to an accurate slider operation. Because of the slider support which contacts a wall of the connector housing, the slider can be prevented from falling inwardly and rattling, and an accurate positioning and a smooth sliding of the slider can be attained. Further, because of the slider support serving also as the follower for the cam groove provided in the connector casing, both related connector housings can be smoothly coupled to each other in the connector casing.

Having now fully described the invention, it will be apparent to one of ordinary skill in the art that many changes and modifications can be made thereto without departing from the spirit and scope of the invention as set forth herein.

What is claimed is:

1. A low coupling force connector comprising:

a pair of first and second connector housings fittable to each other;

a pair of sliders insertable into said first connector housing, each said slider having a cam means provided thereon; and an engagement protrusion provided on said second connector housing, slidable in said cam means, wherein each said slider has a rigid engagement projection projecting from an end thereof, in a fitting direction of said first and second connector housings, opposite from said second connector housing, and said first connector housing has a guide slit for insertion therein of said engagement projection of said pair of sliders.

2. The low coupling force connector according to claim 1, wherein said engagement projection extends on an end surface of said slider to lie in the same plane as said slider lies.

3. The low coupling force connector according to claim 1, wherein said guide slit is located inside said first connector housing.

4. The low coupling force connector according to claim 1, wherein said slider has an enlarged portion at a free end of said engagement projection to form a pair of engagement grooves at opposite sides of said slider, and said guide slit forms a pair of guide rails at opposite sides thereof which engage in said pair of engagement grooves.

5. The low coupling force connector according to claim 1, wherein said slider has a support for sliding projecting at one side thereof, which includes an engagement portion and a support portion projecting from said engagement portion, and said first connector housing is provided in one wall thereof with a guide slit through which said engagement portion extends to have said support portion contacted with said one wall of said first connector housing.

6. A low coupling force connector comprising:

a pair of first and second connector housings fittable to each other;

sliders insertable into said first connector housing, said sliders having a cam means provided thereon; and an engagement protrusion provided on said second connector housing, slidable in said cam means, wherein said sliders have an engagement projection at an end thereof, in a fitting direction of said first and second connector housings, remote from said second connector housing, and said first connector housing has a guide slit for insertion therein of said engagement projection of said sliders, and wherein two of said sliders are provided symmetrically by 180° rotation to be insertable into said first connector housing from opposite directions.

7. A low coupling force connector comprising:

a pair of first and second connector housings fittable to each other;

a slider insertable into said first connector housing, said slider having a cam means provided thereon; and an engagement protrusion provided on said second connector housing, slidable in said cam means, wherein said slider has an engagement projection at an end thereof, in a fitting direction of said first and second connector housings, remote from said second connector housing, and said first connector housing has a guide slit for insertion therein of said engagement projection of said slider; and said slider has an enlarged portion at a free end of said engagement projection to provide a pair of engagement grooves at opposite sides of said slider, and said guide slit forms a pair of guide rails at opposite sides thereof which engage in said pair of engagement grooves.

8. The low coupling force connector according to claim 7, wherein said slider has a support for sliding projecting at one side thereof, which includes an engagement portion and a support portion projecting from said engagement portion, and said first connector housing is provided in one wall thereof with a guide slit through which said engagement portion extends to have said support portion contacted with said one wall of said first connector housing.

9. The low coupling force connector according to claim 8, wherein said support for sliding extends for a part or all of the entire length of said slider in a sliding direction thereof.

10. The low coupling force connector according to claim 8, wherein said support portion projects perpendicularly, in one direction, from said engagement portion.

11. The low coupling force connector according to claim 8, wherein said support portion projects perpendicularly, in two opposite directions, from said engagement portion.

12. The low coupling force connector according to claim 8, further comprising a connector casing in which said first and second connector housings are fitted to each other, said connector casing having a second cam means provided thereon, wherein said engagement portion and said support portion of said support for sliding have small and large diameters, respectively, to constitute a follower protrusion slidable in said second cam means of said connector casing.

* * * * *